US009828766B2

(12) United States Patent
Mori et al.

(10) Patent No.: US 9,828,766 B2
(45) Date of Patent: Nov. 28, 2017

(54) CONSTRUCTION BLOCK AND WALL FACE STRUCTURE USING SAME

(71) Applicant: IIDA GROUP HOLDINGS CO., LTD., Tokyo (JP)

(72) Inventors: Kazuhiko Mori, Tokyo (JP); Yoichi Nishikawa, Tokyo (JP); Ayumu Watanabe, Tokyo (JP); Masahiro Kikuchi, Tokyo (JP); Yusuke Minagawa, Tokyo (JP); Atsushi Hirokawa, Tokyo (JP)

(73) Assignee: IIDA GROUP HOLDINGS CO., LTD., Tokyo (JP)

( * ) Notice: Subject to any disclaimer, the term of this patent is extended or adjusted under 35 U.S.C. 154(b) by 0 days.

(21) Appl. No.: 15/320,617

(22) PCT Filed: Jul. 1, 2015

(86) PCT No.: PCT/JP2015/069029
§ 371 (c)(1),
(2) Date: Dec. 20, 2016

(87) PCT Pub. No.: WO2016/002851
PCT Pub. Date: Jan. 7, 2016

(65) Prior Publication Data

US 2017/0145687 A1 May 25, 2017

(30) Foreign Application Priority Data

Jul. 4, 2014 (JP) ..... 2014-138646

(51) Int. Cl.
*E04B 1/00* (2006.01)
*E04B 5/00* (2006.01)
(Continued)

(52) U.S. Cl.
CPC ..... *E04B 2/46* (2013.01); *E04B 2/54* (2013.01); *E04C 1/39* (2013.01); *E04B 2/08* (2013.01);
(Continued)

(58) Field of Classification Search
CPC ..... E04B 2/24; E04B 2/20; E04B 2/18; E04B 2/48; E04B 2/26; E04B 2/46; E04B 2/52;
(Continued)

(56) References Cited

U.S. PATENT DOCUMENTS 2,199,112 A * 4/1940 O'Leary ..... E04B 2/18 52/314
3,546,833 A * 12/1970 Perreton ..... E04B 2/46 52/314
(Continued)

FOREIGN PATENT DOCUMENTS

JP S64-21146 A 1/1989
JP H03-11713 U 2/1991
(Continued)

OTHER PUBLICATIONS

Aug. 18, 2015 International Search Report issued in International Patent Application No. PCT/JP2015/069029.

*Primary Examiner* — Chi Q Nguyen
(74) *Attorney, Agent, or Firm* — Oliff PLC

(57) ABSTRACT

A construction block and a wall face structure with high durability and versatility are provided. The construction block including: a front face wall and a rear face wall being parallel to each other; a top face wall with a horizontal groove formed for inserting a horizontal reinforcement; side face walls formed with at least one vertical groove for inserting a vertical reinforcement; at least one vertical hole formed between both of the side face walls and closed off by the top face wall and opened at a bottom face; a plurality of
(Continued)

protrusions formed on the bottom face in a shape to engage with the horizontal groove; and recessed slits respectively formed in vertical direction on each side face of the front face wall and the rear face wall, is used.

12 Claims, 12 Drawing Sheets

(51) Int. Cl.

| | |
|---|---|
| ***E04B 7/00*** | (2006.01) |
| ***E04B 2/46*** | (2006.01) |
| ***E04C 1/39*** | (2006.01) |
| ***E04B 2/54*** | (2006.01) |
| *E04B 2/02* | (2006.01) |
| *E04B 2/18* | (2006.01) |
| *E04B 2/20* | (2006.01) |
| *E04C 1/41* | (2006.01) |
| *E04B 2/48* | (2006.01) |
| *E04B 2/08* | (2006.01) |
| *E04B 2/24* | (2006.01) |
| *E04B 2/26* | (2006.01) |
| *E04C 1/40* | (2006.01) |
| *E04B 2/52* | (2006.01) |

(52) U.S. Cl.
CPC . *E04B 2/18* (2013.01); *E04B 2/20* (2013.01); *E04B 2/24* (2013.01); *E04B 2/26* (2013.01); *E04B 2/48* (2013.01); *E04B 2/52* (2013.01); *E04B 2002/0206* (2013.01); *E04B 2002/0215* (2013.01); *E04B 2002/0254* (2013.01); *E04C 1/40* (2013.01); *E04C 1/41* (2013.01)

(58) Field of Classification Search
CPC ..... E04B 2/08; E04B 2002/0206; E04B 2002/0254; E04C 1/41; E04C 1/40
USPC ..... 52/284, 604, 608, 220.2, 745.1, 286, 52/220.1, 220.8, 605, 606, 607, 503, 504, 52/505; 446/120, 124, 127, 128
See application file for complete search history.

(56) References Cited

U.S. PATENT DOCUMENTS

| | | | | | |
|---|---|---|---|---|---|
| 5,678,378 | A * | 10/1997 | Ellison, Jr. | E04B 5/10 | 52/320 |
| 5,684,589 | A * | 11/1997 | Mark | G01C 19/72 | 356/464 |
| 5,822,939 | A * | 10/1998 | Haener | E04C 1/41 | 52/286 |
| 6,065,265 | A * | 5/2000 | Stenekes | E04B 2/46 | 52/100 |
| 6,280,121 | B1 * | 8/2001 | Khamis | E02D 29/0225 | 405/284 |
| 8,074,419 | B1 | 12/2011 | Humphress et al. | | |
| 2008/0184650 | A1 * | 8/2008 | Fischer | B28B 7/0097 | 52/606 |
| 2008/0250739 | A1 * | 10/2008 | Krupinski | B65D 1/22 | 52/309.4 |
| 2014/0007529 | A1 * | 1/2014 | Alvarez Moysen | E04B 2/18 | 52/220.2 |
| 2014/0053493 | A1 * | 2/2014 | Carey | E04C 1/24 | 52/604 |
| 2015/0218805 | A1 * | 8/2015 | Jensen | E04B 2/26 | 52/309.4 |

FOREIGN PATENT DOCUMENTS

| | | | |
|---|---|---|---|
| JP | H08-177059 | A | 7/1996 |
| JP | 3056674 | U | 2/1999 |
| JP | 2002-339480 | A | 11/2002 |
| JP | 2004-147553 | A | 5/2004 |

* cited by examiner

Types of Test Body

| Mark | Purpose | Size | |
|---|---|---|---|
| | | Single Body of Block | Test Body |
| A | 10mm |   |   |
| B | 3mm |   |   |

CONSTRUCTION BLOCK AND WALL FACE STRUCTURE USING SAME

BACKGROUND OF THE INVENTION

Field of the Invention

Present invention relates to a construction block for configuring a wall and else of a construction. This application is based upon and claims the benefit of priority from the Japanese Patent Application No. 2014-138646 filed in Japan on Jul. 4, 2014.

Description of Related Art

In the past, a brick formed by calcining clay molded in a shape of block, or a concrete block formed by molding and hardening a stiff-consistency concrete in a shape of block are known as a construction block.

For example, a wall separating a residential premises and a street is normally constructed by piling concrete blocks, and in some cases, by inserting reinforcements inside the concrete blocks. A size of the concrete block is standardized, and it is possible to obtain concrete blocks with various qualities, and it is easy to supply large quantities of concrete blocks inexpensively.

In concrete blocks, there are a concrete block with hollow structure (hollow concrete block) and a concrete block with solid structure (solid concrete block), and they can be sorted into a reinforced concrete block, a fill-up concrete block, a curtain wall concrete block, and else.

The reinforced concrete block is used to construct a bearing wall by arranging reinforcement at a hollow part of the hollow concrete block, and by filling concrete or mortar into the hollow part. The fill-up concrete block is used to construct a bearing wall by configuring a frame by combining the concrete blocks in the shape of L, T, H, and else, and by filling concrete into inside of the frame. Further, the curtain wall concrete block is used to construct a wall body by laying blocks between rigid frame of steel-framed or reinforced concrete structure.

In addition, there are three types in the hollow concrete block, which are BI type, BS type, and BM type, and their sizes are defined by JIS.

Here, a plate-like lightweight concrete block configured as rectangular solid structure equivalent to the connected size of a plurality of hollow concrete blocks in a planar direction, in which long grooves are formed at end face of at least one of short side and long side thereof, and a method for constructing a boundary wall by piling a plurality of the plate-like lightweight concrete blocks in a planar state, and by arranging reinforcements at the long grooves, and by filling mortar into the long grooves, are proposed (for example, refer to patent literature 1).

Also, a greening block capable of easily combining the blocks vertically and horizontally by fitting structure, which does not form mortar joints on outer surface, and configured to greening the block by growing plants from upper parts and voids of the blocks, is proposed (for example, refer to patent literature 2).

Patent Literature 1: JP 2002-339480 A

Patent Literature 2: JP 2004-147553 A

SUMMARY OF THE INVENTION

However, as a block used for constructing a wall and else, it could be simply a rectangular cube, but generally, a block with a basic form of rectangular cube and added with convex-concave shape for strengthening a bond is heavily used. For example, a concrete block heavily used for constructing moat is having three longitudinal cavities, and provided with recessed grooves on both sides, and for bonding both blocks side by side, mortar is filled between mating both recessed grooves. However, with this configuration, there is no direct connection with each other, so its strength stability cannot be trusted only by mortar.

Also, by adopting an engagement structure with protrusion and recess, which are mutually engageable with adjacent blocks vertically and horizontally, it is possible to easily combine the blocks vertically and horizontally. However, as the technology disclosed on patent literature 2, it is not possible to secure a sufficient bonding strength between blocks combined vertically for the greening block, which does not form mortar joints on outer surface, and configured to greening the block by growing plants from upper parts and voids of the blocks. In other words, with a bonding structure by two protrusions 11 and two protrusions 16*a* respectively extending in longitudinal direction in FIG. 2 of patent literature 2, it is not possible to secure a bonding strength when force is applied in a thickness direction of the blocks perpendicular to the longitudinal direction.

Also, in regions with strong tremor or in regions that the liquefaction occurred at the Great East Japan Earthquake in 2011, even reinforcements were inserted inside the concrete blocks, the reinforcements could not support a weight of the blocks and damage occurred such as the walls inclined, or fallen from the base.

Therefore, considering the above conventional circumstances, the purpose of the present invention is to provide a construction block and a wall face structure with high durability and versatility.

The other purpose of the present invention and specific advantages obtained by the present invention will be more apparent from an explanation of embodiments explained in below.

The present invention is a construction block with a basic form of rectangular cube and capable of constructing a wall face structure by aligning a plurality of construction blocks in planar shape by abutting their outer peripheral surfaces to each other, comprising: a front face wall and a rear face wall being parallel to each other; a top face wall with a horizontal groove formed for inserting a horizontal reinforcement; side face walls with at least one vertical groove formed for inserting a vertical reinforcement; at least one vertical hole formed between both of the side face walls and closed off by the top face wall and opened at a bottom face; a plurality of protrusions formed on the bottom face in a shape to engage with the horizontal groove; and recessed slits respectively formed in vertical direction on each side face of the front face wall and the rear face wall, wherein the plurality of protrusions are formed on the bottom face in such a manner that they respectively continue over full width of the horizontal groove in width direction of the horizontal groove and that they are distributed in horizontal direction of the horizontal groove.

Also, the present invention is a construction block with a basic form of rectangular cube and capable of constructing a wall face structure by aligning a plurality of construction blocks in planar shape by abutting their outer peripheral surfaces to each other, comprising: a front face wall and a rear face wall being parallel to each other; a top face wall with a horizontal groove formed for inserting a horizontal reinforcement; side face walls with at least one vertical groove formed for inserting a vertical reinforcement; at least one vertical hole formed between both of the side face walls and closed off by the top face wall and opened at a bottom face; a plurality of protrusions formed on the bottom face in a shape to engage with the horizontal groove; and a pair of protruding strips formed continuously in vertical direction to protrude in horizontal direction from one of the side face walls respectively on one end face of the front face wall and the rear face wall and formed in a shape to engage with the other of the side face walls, wherein the plurality of protrusions are formed on the bottom face in such a manner that they respectively continue over full width of the horizontal groove in width direction of the horizontal groove and that they are distributed in horizontal direction of the horizontal groove.

The construction block relating to the present invention may be configured that the vertical groove for inserting the vertical reinforcement is formed on both of the side face walls.

Also, the construction block relating to the present invention may be configured that the vertical groove for inserting the vertical reinforcement is formed on one of the side face walls, and that a vertical hole for inserting the vertical reinforcement penetrating in vertical direction is formed on the other of the side face walls.

The present invention is a wall face structure constructed by construction blocks with a basic form of rectangular cube, comprising: a front face wall and a rear face wall being parallel to each other; a top face wall with a horizontal groove formed for inserting a horizontal reinforcement; side face walls with at least one vertical groove formed for inserting a vertical reinforcement; at least one vertical hole formed between both of the side face walls and closed off by the top face wall and opened at a bottom face; a plurality of protrusions formed on the bottom face in a shape to engage with the horizontal groove; and recessed slits respectively formed in vertical direction on each side face of the front face wall and the rear face wall, wherein the plurality of protrusions are formed on the bottom face in such a manner that they respectively continue over full width of the horizontal groove in width direction of the horizontal groove and that they are distributed in horizontal direction of the horizontal groove, wherein the wall face structure is constructed by bonding and fixing each construction block to each other by aligning construction blocks with vertical grooves formed for inserting vertical reinforcements on both of the side face walls in horizontal direction, and by arranging construction blocks with the vertical groove formed for inserting the vertical reinforcement on one of the side face walls and with a vertical hole formed for inserting the vertical reinforcement penetrating in vertical direction on the other of the side face walls at ends of the horizontal direction, and by abutting outer peripheral surfaces of each construction block to each other, and by aligning a plurality of construction blocks in planer shape by engaging the plurality of protrusions of the construction blocks positioned at upper side to horizontal grooves of the construction blocks positioned at lower side, and by filling mortar into the vertical grooves and vertical holes inserted with the vertical reinforcements, and by filling mortar into horizontal grooves inserted with horizontal reinforcements, and by intervening joint mortar between abutting surfaces of the construction blocks.

Also, the present invention is a wall face structure constructed by construction blocks with a basic form of rectangular cube, comprising: a front face wall and a rear face wall being parallel to each other; a top face wall with a horizontal groove formed for inserting a horizontal reinforcement; side face walls with at least one vertical groove formed for inserting a vertical reinforcement; at least one vertical hole formed between both of the side face walls and closed off by the top face wall and opened at a bottom face; a plurality of protrusions formed on the bottom face in a shape to engage with the horizontal groove; and a pair of protruding strips formed continuously in vertical direction to protrude in horizontal direction from one of the side face walls respectively on one end face of the front face wall and rear face wall and formed in a shape to engage with the other of the side face wall, wherein the plurality of protrusions are formed on the bottom face in such a manner that they respectively continue over full width of the horizontal groove in width direction of the horizontal groove and that they are distributed in horizontal direction of the horizontal groove, wherein the wall face structure is constructed by bonding and fixing each construction block to each other by aligning construction blocks with vertical grooves formed for inserting vertical reinforcements on both of the side face walls in horizontal direction, and by arranging construction blocks with a vertical groove formed for inserting vertical reinforcement on one of the side face walls and with a vertical hole formed for inserting the vertical reinforcement penetrating in vertical direction on the other of the side face walls at ends of the horizontal direction, and by abutting outer peripheral surfaces of each construction block to each other, and by aligning a plurality of construction blocks in planer shape by engaging the plurality of protrusions of the construction blocks positioned at upper side to horizontal grooves of the construction blocks positioned at lower side, and by filling mortar into the vertical grooves and vertical holes inserted with the vertical reinforcements, and by filling mortar into horizontal grooves inserted with horizontal reinforcements, and by intervening joint mortar between abutting surfaces of the construction blocks.

A wall face structure relating to the present invention includes a wall face structure formed by three construction blocks abutted in T-shape, comprising a vertically continuing opening formed by deleting an abutment of each front face wall or each rear face wall of two construction blocks arranged adjacently in horizontal direction with their side face wall opposing to each other, and constructed by abutting each side face of the front face wall or the rear face wall of other construction block to the two construction blocks in such a manner that the opening will be occluded by the side face wall of the other construction block formed with the vertical groove for inserting the vertical reinforcement.

Also, a wall face structure relating to the present invention includes a wall face structure formed by abutting two construction blocks in L-shape, comprising a vertically continuing opening formed by deleting an abutment of front face wall or rear face wall of construction block positioned at end of horizontal direction, and constructed by abutting each side face of front face wall or rear face wall of other construction block to the construction block in such a manner that the opening will be occluded by the side face wall of the other construction block formed with the vertical groove for inserting the vertical reinforcement.

A construction block relating to the present invention is a construction block with a basic form of rectangular cube and capable of constructing a wall face structure by aligning a plurality of construction blocks in planar shape by abutting their outer peripheral surfaces to each other, comprising: a front face wall and a rear face wall being parallel to each other; a top face wall with a horizontal groove formed for inserting a horizontal reinforcement; side face walls with at least one vertical groove formed for inserting a vertical reinforcement; at least one vertical hole formed between both of the side face walls and closed off by the top face wall and opened at a bottom face; a plurality of protrusions formed on the bottom face in a shape to engage with the horizontal groove; and recessed slits respectively formed in vertical direction on each side face of the front face wall and the rear face wall, wherein the plurality of protrusions are formed on the bottom face in such a manner that they respectively continue over full width of the horizontal groove in width direction of the horizontal groove and that they are distributed in horizontal direction of the horizontal groove, so it is possible to construct a wall face structure by bonding and fixing each construction block to each other by aligning the construction blocks with vertical grooves formed for inserting vertical reinforcements on both of the side face walls in horizontal direction, and by arranging construction blocks with the vertical groove formed for inserting the vertical reinforcement on one of the side face walls and with a vertical hole for inserting the vertical reinforcement penetrating in vertical direction on the other of the side face walls at ends of the horizontal direction, and by abutting outer peripheral surfaces of each construction block to each other, and by aligning a plurality of construction blocks in planer shape by engaging the plurality of protrusions of the construction blocks positioned at upper side to horizontal grooves of the construction blocks positioned at lower side, and by filling mortar into the vertical grooves and vertical holes inserted with the vertical reinforcements, and by filling mortar into horizontal grooves inserted with horizontal reinforcements, and by intervening joint mortar between abutting surfaces of the construction blocks.

Therefore, by the present invention, it is possible to provide a construction block and a wall face structure with high durability and versatility.

DETAILED DESCRIPTION OF THE INVENTION

In below, the embodiments of the present invention are explained in detail with reference to the drawings. It goes without saying that the present invention will not be limited to the following examples, and that it can be changed optionally within the scope not deviating from the gist of the present invention.

Figure 1:
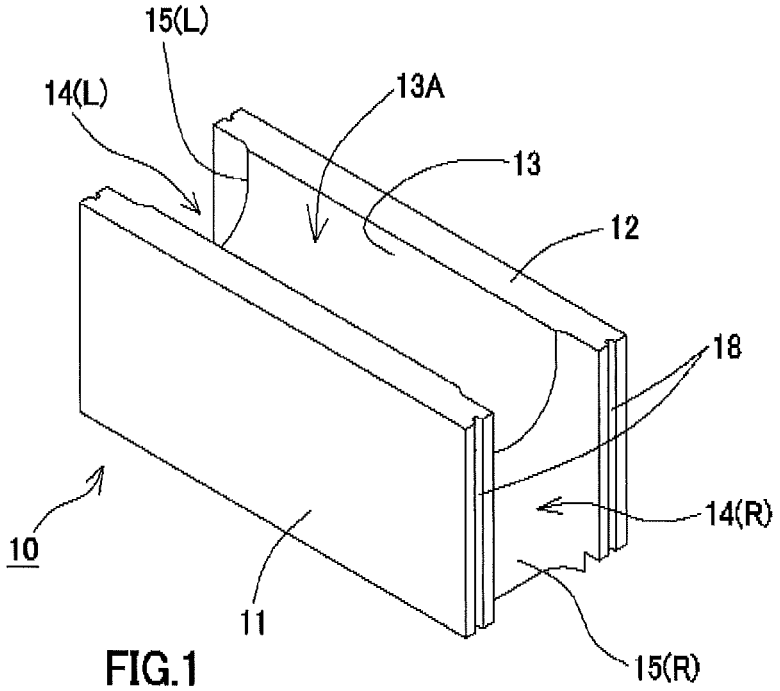
FIG. 1 is a perspective view illustrating an example of a construction block applying the present invention.
Figure 2:
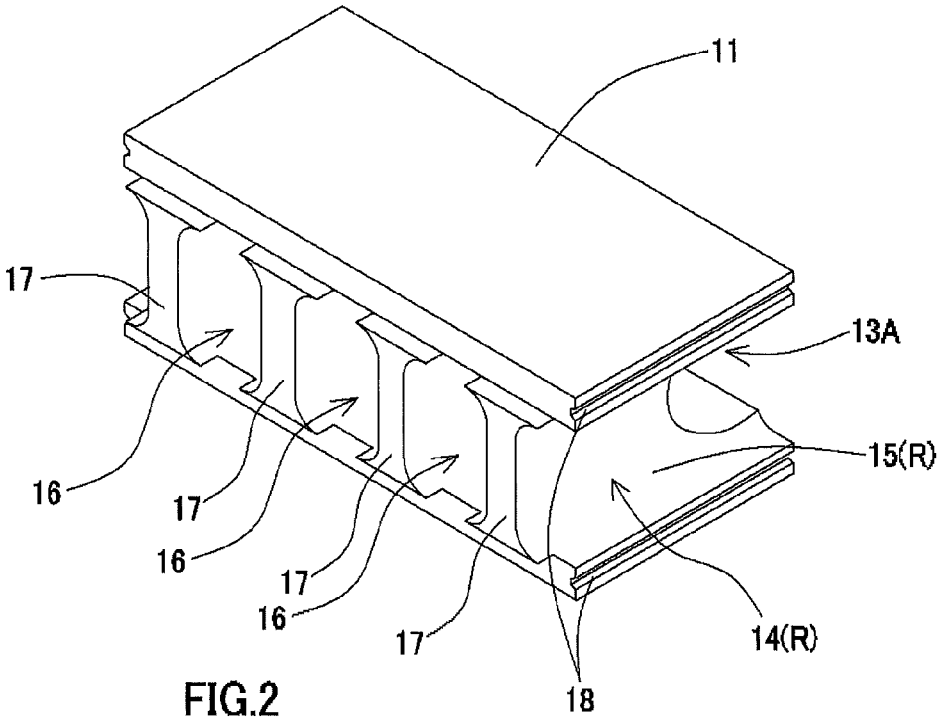
FIG. 2 is a perspective view of the construction block seen from bottom obliquely.

FIGS. 1 and 2 are views illustrating an embodiment of a construction block relating to the present invention, and FIG. 1 is a perspective view of a construction block 10 applying the present invention seen from above obliquely, and FIG. 2 is a perspective view of the construction block 10 applying the present invention seen from bottom obliquely.

The construction block 10 of this embodiment is for example a construction concrete block used for construction of wall or fence, comprising: a front face wall 11 and a rear face wall 12 being parallel to each other; a top face wall 13 with a horizontal groove 13A formed for inserting a horizontal reinforcement; side face walls 15 with vertical grooves 14 formed for inserting vertical reinforcements; at least one vertical hole 16 formed between both of the side face walls 15(R) and 15(L) and closed off by the top face wall 13 and opened at a bottom face; a plurality of protrusions 17 formed on the bottom face in a shape to engage with the horizontal groove 13A; and recessed slits 18 respectively formed in vertical direction on each side face of the front face wall 11 and the rear face wall 12.

In this construction block 10, as illustrated in FIG. 1, it comprises: a front face wall 11 and a rear face wall 12 being parallel to each other; a right side face wall 15(R) formed with a vertical groove 14(R) for inserting a vertical reinforcement; and a left side face wall 15(L) formed with a vertical groove 14(L) for inserting a vertical reinforcement.

Also, this construction block 10 comprises three vertical holes 16 formed between both of the side face walls 15(R) and 15(L), as illustrated in FIG. 2. The three vertical holes 16 are closed off by the top face wall 13 and opened at the bottom face.

Also, this construction block 10 comprises four protrusions 17 protruding from bottom face of side walls between the vertical grooves 14(R) and 14(L) and the vertical holes 16, as illustrated in FIG. 2. The four protrusions 17 are formed on the bottom face in such a manner that they respectively continue over full width of the horizontal groove 13A in width direction of the horizontal groove 13A and that they are distributed in horizontal direction of the horizontal groove 13A, and they are having a shape to engage with the horizontal groove 13A formed on the top face wall 13 in a state securing a space for inserting the horizontal reinforcement.

Further, this construction block 10 comprises recessed slits 18 respectively formed in vertical direction on each side face of the front face wall 11 and the rear face wall 12, as illustrated in FIGS. 1 and 2.

Here, in order to confirm an effect of the protrusions 17 of the construction block 10, shear and pressure test was conducted about a piled structure of construction blocks without the protrusions 17 for comparison, and by comparing shear strength between them, a result as follows was obtained.

Figure 3:
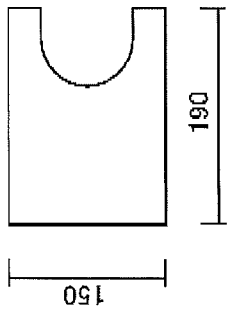
FIG. 3 is a schematic view of a test body used for durability test of wall face formed by piling the construction blocks.
Figure 3:
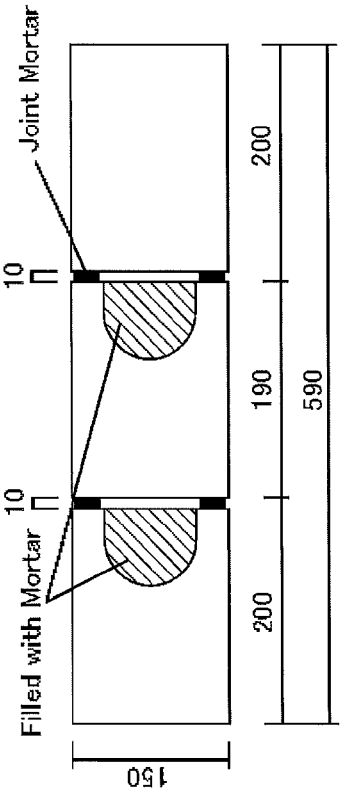
Figure 3:
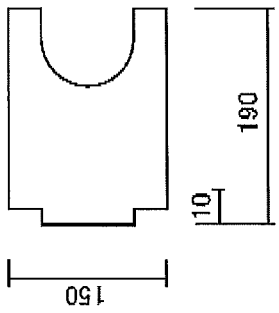
Figure 3:
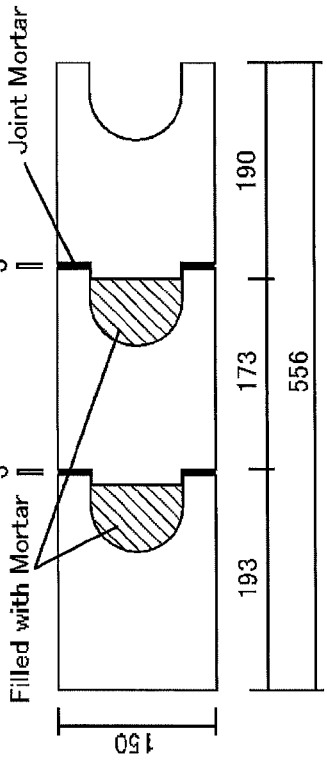
Figure 4:
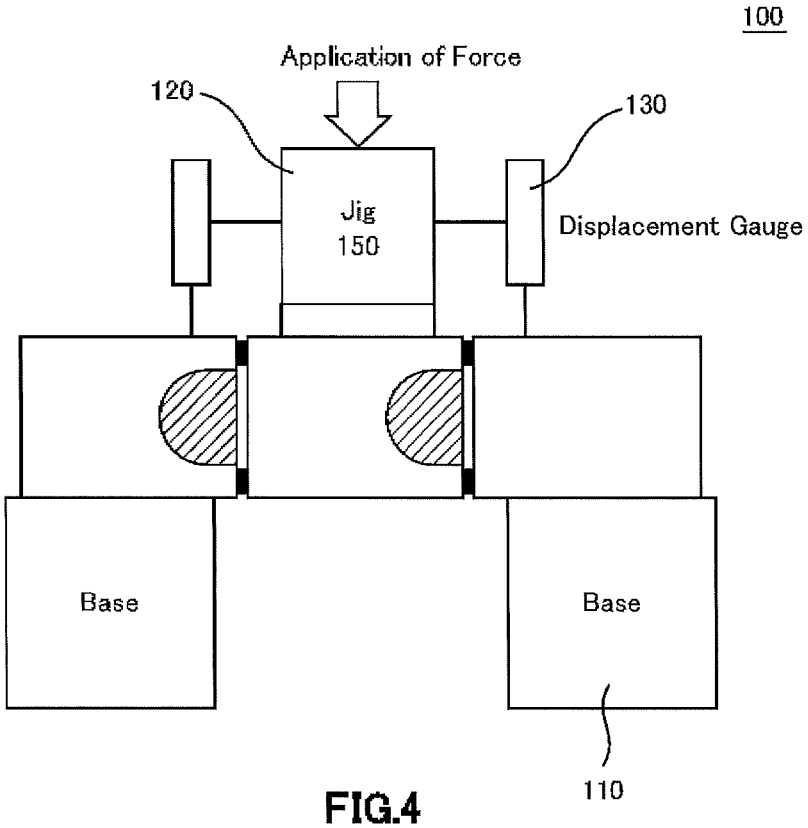
FIG. 4 is a schematic view for explaining a method of durability test of wall face formed by piling the construction blocks.

Test bodies were two types each with three blocks as illustrated in FIG. 3. A test body A used a concrete block C type as a construction block without the protrusions, and piled for three blocks by applying mortar at ribs after filling mortar into horizontal grooves for inserting horizontal reinforcements. A test body B used a concrete block C type with 10 mm notch at lower part as a construction block with the protrusions, and piled for three blocks by applying mortar at ribs after filling mortar into horizontal grooves for inserting horizontal reinforcements. Curing time was two days.

Testing method used a vertical actuator testing machine 100, and placed blocks at both sides of the test body on bases 110, and applied a force to a central block until destruction by monotonous application of force via a force applying jig 120 (width 150 mm). Displacement gauges (CDP100 made by Tokyo Sokki Kenkyujo Co., Ltd.) 130 were fixed at four points of the jig, and recorded relative displacement with respect to the blocks at both sides, and displacement of four points were determined on average.

Figure 5:
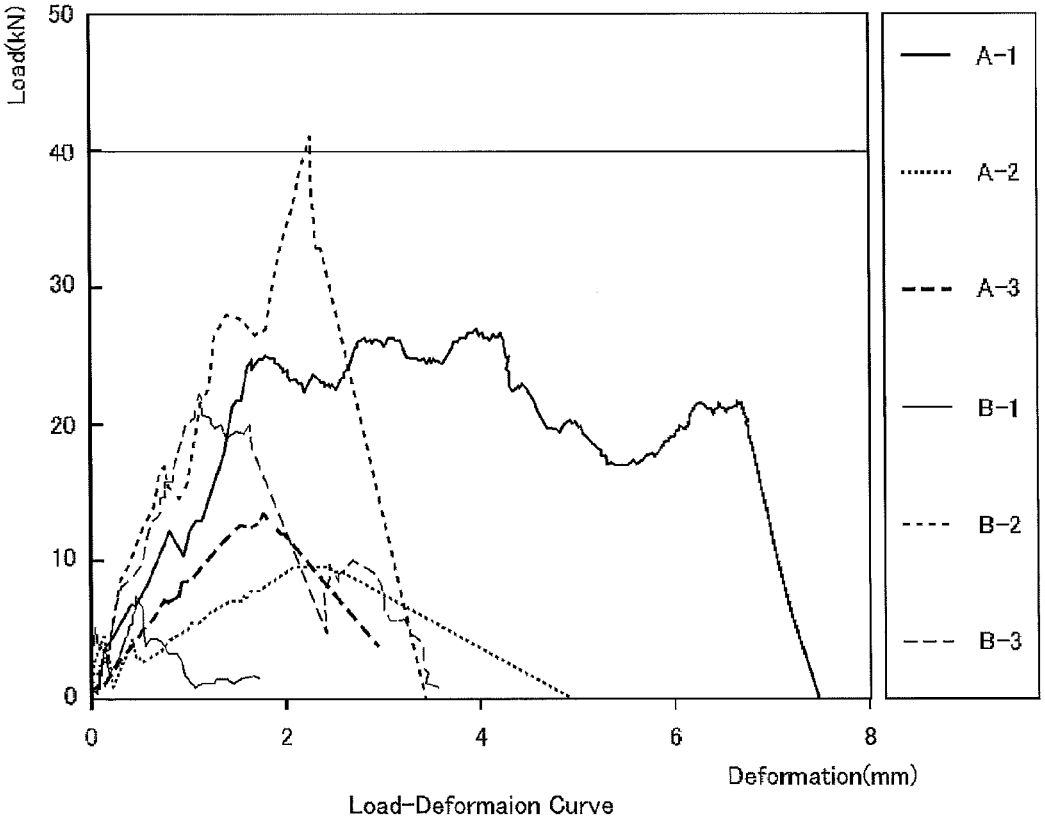
FIG. 5 is a diagram illustrating a result of durability test of wall face formed by piling the construction blocks, together with a result of durability test of wall face formed by piling construction blocks with conventional structure.

As a result of the shear and pressure test, load-deformation curves as illustrated in FIG. 5 were obtained. Also, maximum load of each test body is indicated in table 1.

TABLE 1

Maximum load of each test body (Unit: kN)

| Test Body | A-1 | A-2 | A-3 | B-1 | B-2 | B-3 |
|---|---|---|---|---|---|---|
| Pmax | 7.49 | 9.76 | 13.49 | 27.02 | 41.24 | 22.32 |
| Average | | 10.25 | | | 30.19 | |

In the test body B, durability decreased once when joint mortar fractured, but durability increased by contact of engagement, and maximum loads were over 20 kN for every blocks with an average of about 30 kN, so it is greatly improved compared to the test body A.

Figure 6:
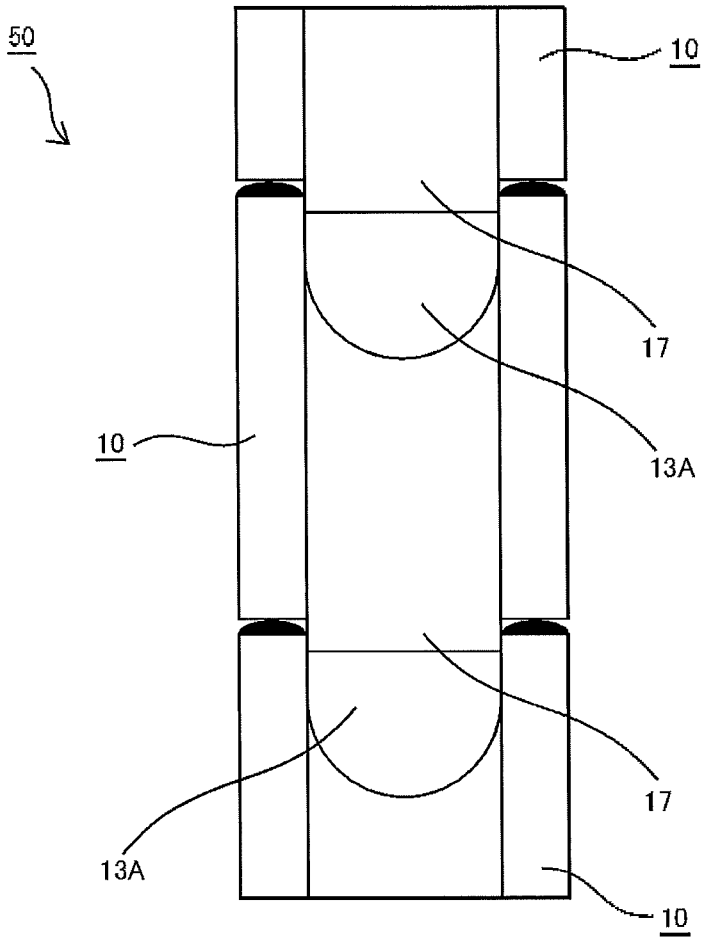
FIG. 6 is a side view illustrating an example of wall face structure formed by piling the construction blocks applying the present invention.

In the construction block 10 with the structure as the above, when constructing a wall face structure by aligning a plurality of construction blocks in planar shape, it is possible to improve durability of a wall face structure 50 by engaging the plurality of protrusions 17 of the construction blocks positioned at upper side to horizontal grooves 13A of the construction blocks positioned at lower side, as illustrated in FIG. 6.

Also, the construction block 10 comprises recessed slits 18 respectively formed in vertical direction on each side face of the front face wall 11 and the rear face wall 12, so it is possible to improve durability of joint mortar intervening between abutting surfaces of the construction blocks 10. In other words, the joint mortar intervening between the abutting surfaces of the construction blocks 10 set in a state that it enters the recessed slits 18 respectively formed in vertical direction on each side face of the front face wall 11 and the rear face wall 12, so it is possible to bond and fix each construction block 10 solidly. And also, it is possible to construct the wall face structure 50 with high durability by filling mortar into the vertical grooves and vertical holes inserted with the vertical reinforcements, and by filling mortar into horizontal grooves inserted with horizontal reinforcements, and by intervening joint mortar between abutting surfaces of the construction blocks 10.

In other words, it is possible to construct the wall face structure with high durability by this construction block 10 with a basic form of rectangular cube and comprising: a front face wall 11 and a rear face wall 12 being parallel to each other; a top face wall 13 with a horizontal groove 13A formed for inserting a horizontal reinforcement; side face walls 15 with vertical grooves 14 formed for inserting vertical reinforcements; at least one vertical hole 16 formed between both of the side face walls 15(R) and 15(L) and closed off by the top face wall 13 and opened at a bottom face; a plurality of protrusions 17 formed on the bottom face in a shape to engage with the horizontal groove 13A; and recessed slits 18 respectively formed in vertical direction on each side face of the front face wall 11 and the rear face wall 12.

Also, this construction block 10 is reduced of its weight by comprising at least one vertical hole 16 formed between both of the side face walls 15(R) and 15(L) and closed off by the top face wall 13 and opened at a bottom face.

Here, the construction block 10 comprises: a right side face wall 15(R) formed with a vertical groove 14(R) for inserting a vertical reinforcement; and a left side face wall 15(L) formed with a vertical groove 14(L) for inserting a vertical reinforcement, but the construction block relating to the present invention may be configured that the vertical groove for inserting the vertical reinforcement is form on one of the side face walls and that a vertical hole for inserting the vertical reinforcement penetrating in vertical direction is formed on the other of the side face walls.

Figure 7:
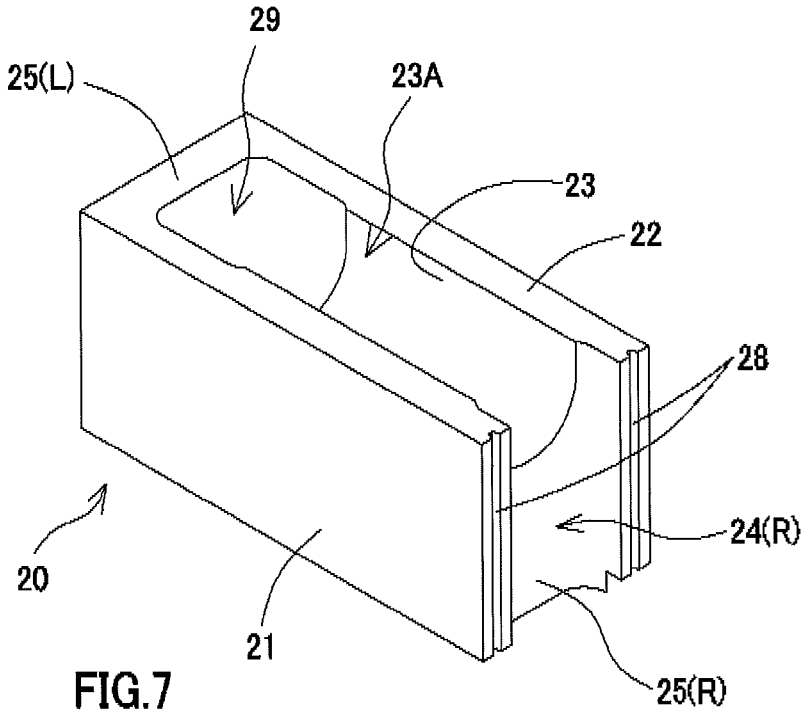
FIG. 7 is a perspective view illustrating other example of a construction block applying the present invention.
Figure 8:
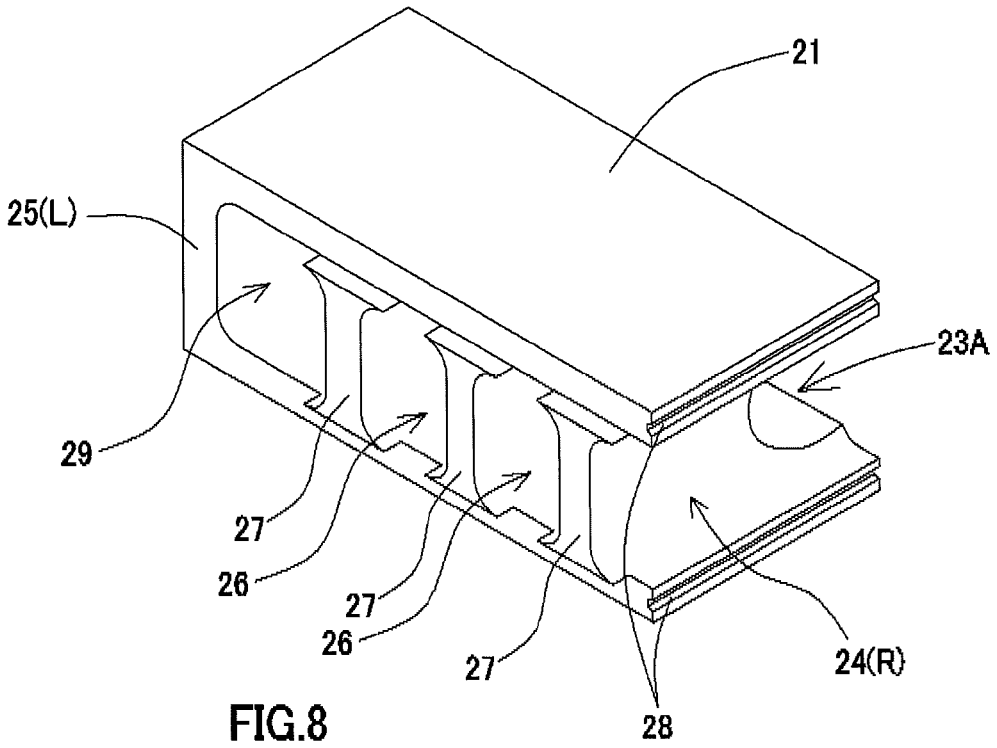
FIG. 8 is a perspective view of the construction block seen from bottom obliquely.

FIGS. 7 and 8 are views illustrating an embodiment of a construction block relating to the present invention, and FIG. 7 is a perspective view of a construction block 20 applying the present invention seen from above obliquely, and FIG. 8 is a perspective view of the construction block 20 seen from bottom obliquely.

The construction block 20 of this embodiment is for example a construction concrete block used for construction of wall or fence, as well as the construction block 10, comprising: a front face wall 21 and a rear face wall 22 being parallel to each other; a top face wall 23 with a horizontal groove 23A formed for inserting a horizontal reinforcement; side face walls 25 with a vertical groove 24 formed for inserting a vertical reinforcement; at least one vertical hole 26 formed between both of the side face walls 25(R) and 25(L) and closed off by the top face wall 23 and opened at a bottom face; a plurality of protrusions 27 formed on the bottom face in a shape to engage with the horizontal groove 23A; and recessed slits 28 respectively formed in vertical direction on each side face of the front face wall 21 and the rear face wall 22.

In this construction block 20, as illustrated in FIG. 7, it comprises: a front face wall 21 and a rear face wall 22 being parallel to each other; a right side face wall 25(R) with a vertical groove 24(R) formed for inserting a vertical reinforcement; a left side face wall 25(L); and a vertical hole 29 for inserting a vertical reinforcement penetrating in vertical direction formed on the left side face wall 25(L).

Also, this construction block 10 further comprises two vertical holes 26 formed between both side face walls 25(R) and 25(L), as illustrated in FIG. 8. These two vertical holes 26 are closed off by the top face wall 23 and opened at the bottom face.

Also, this construction block 20 comprises the vertical groove 24(L), the vertical hole 29, and three protrusions 27 protruding from bottom face of side walls between the vertical holes 26, as illustrated in FIG. 8. The three protrusions 27 are formed on the bottom face in such a manner that they respectively continue over full width of the horizontal groove 23A in width direction of the horizontal groove 23A and that they are distributed in horizontal direction of the horizontal groove 23A, and they are having a shape to engage with the horizontal groove 23A formed on the top face wall 23 in a state securing a space for inserting the horizontal reinforcement.

Further, this construction block 20 comprises recessed slits 28 respectively formed in vertical direction on each side face of the front face wall 21 and the rear face wall 22, as illustrated in FIGS. 7 and 8.

The construction block 20 with this kind of structure is used as a construction block arranged at end of horizontal direction of wall face structure constructed by the construction blocks 10 relating to the present invention.

Figure 9:
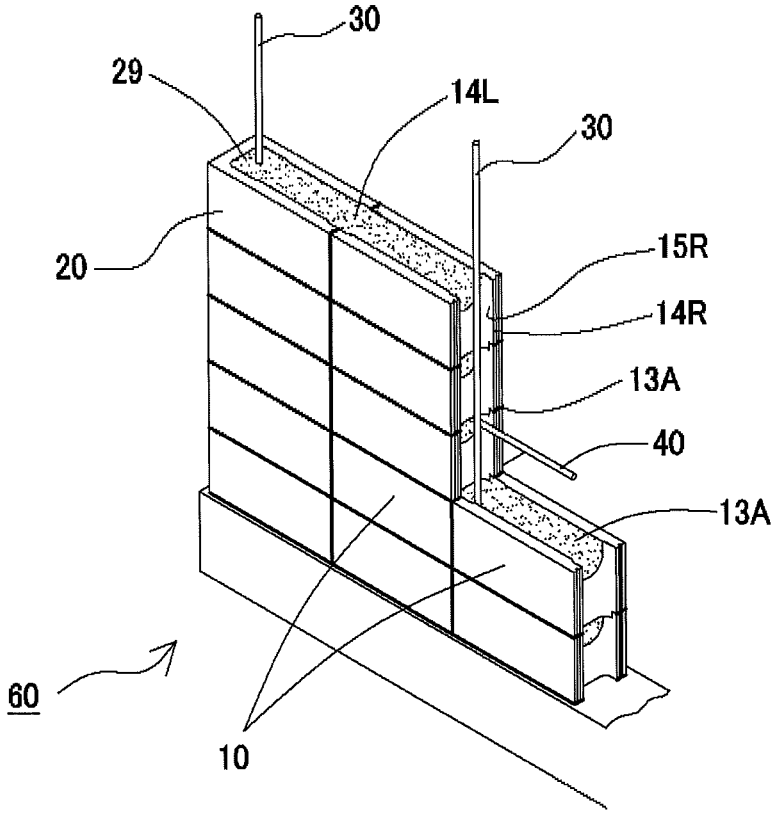
FIG. 9 is a side view illustrating an example of a wall face structure formed by piling the above two types of construction blocks applying the present invention.

In other words, as illustrated in FIG. 9, the construction blocks 10 and 20 with the structure as the above are capable of constructing a wall face structure 60 with high durability by aligning the construction blocks 10 with the vertical grooves 14(R) and 14(L) formed for inserting the vertical reinforcements on both of the side face walls 15(R) and 15(L) in horizontal direction, and by arranging construction blocks 20 with the vertical groove 24(R) formed for inserting the vertical reinforcement on one 25(R) of the side face walls and with the vertical hole 29 for inserting the vertical reinforcement penetrating in vertical direction on the other 25(L) of the side face walls at ends of the horizontal direction, and by abutting outer peripheral surfaces of each construction block to each other, and by aligning a plurality of construction blocks in planer shape by engaging the plurality of protrusions 17 and 27 of the construction blocks 10 and 20 positioned at upper side to the horizontal grooves 13A and 23A of the construction blocks 10 and 20 positioned at lower side, and by filling mortar into the vertical grooves 14(R) and the vertical holes 29 inserted with the vertical reinforcements 30, and by filling mortar into the horizontal grooves 13A and 23A inserted with the horizontal reinforcements 40, and by intervening joint mortar between abutting surfaces of the construction blocks.

Figure 10A:
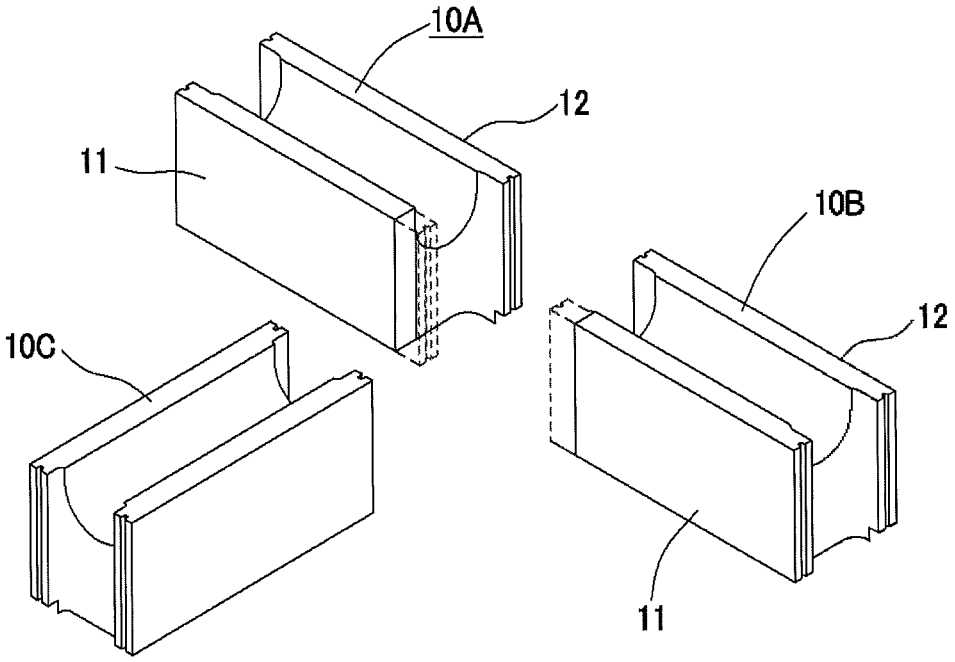
FIG. 10 is a view illustrating a state using the construction blocks applying the present invention by combining them in T-shape, (A) a perspective view illustrating a state that three construction blocks are separated, (B) a plan view illustrating a state that three construction blocks are abutted and bonded.
Figure 10B:
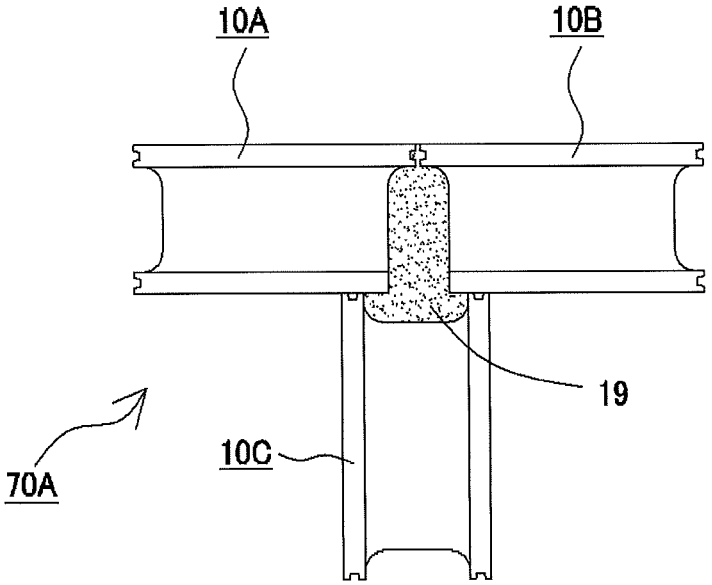

Here, as illustrated in FIGS. 10 (A) and (B), the construction blocks 10 are capable of constructing a wall face structure 70A formed by three construction blocks 10A, 10B and 10C abutted in T-shape, by providing a vertically continuing opening 19 formed by deleting an abutment of each front face wall or each rear face wall of two construction blocks 10A and 10B arranged adjacently in horizontal direction with their side face wall abutted to each other, and by abutting the side face wall of other construction block 10C with the vertical groove formed for inserting the vertical reinforcement to the two construction blocks 10A and 10C in such a manner that the opening 19 will be occluded by the side face wall of the other construction block 10C.

Figure 11A:
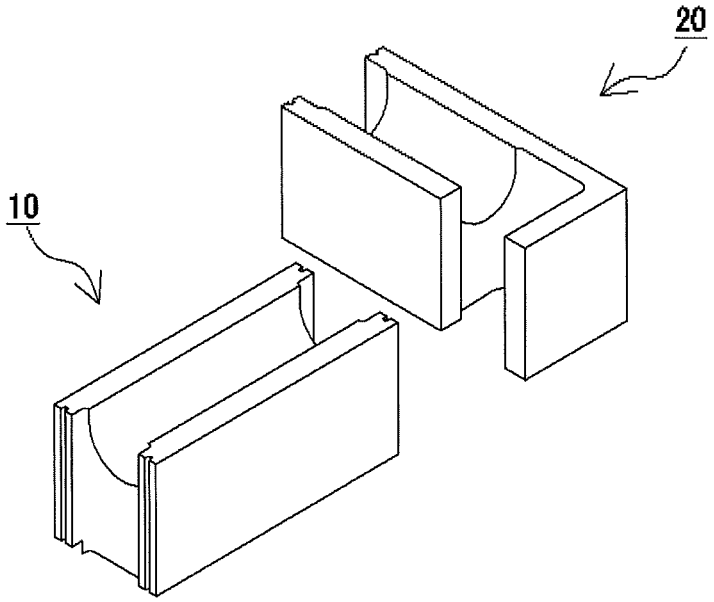
FIG. 11 is a view illustrating a state using the construction blocks applying the present invention by combining them in L-shape, (A) a perspective view illustrating a state that two construction blocks are separated, (B) a plan view illustrating a state that two construction blocks are abutted and bonded.
Figure 11B:
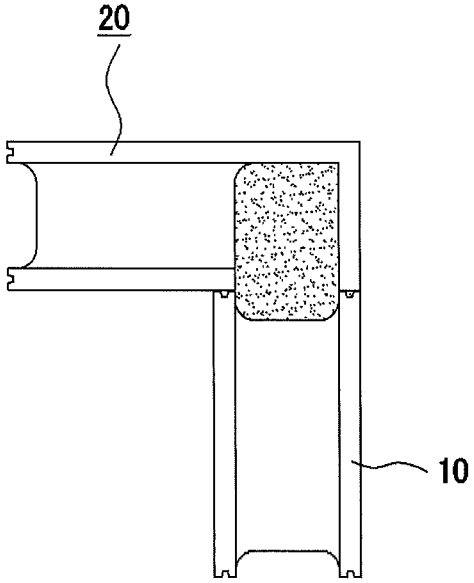

Here, as illustrated in FIGS. 11 (A) and (B), the construction blocks 10 and 20 are capable of constructing a wall face structure 70B formed by two construction blocks 10 and 20 abutted in L-shape, by providing a vertically continuing opening 29 formed by deleting an abutment of the front face wall 21 or the rear face wall 22 of the construction block 20 positioned at end of horizontal direction, and by abutting the side face wall of the construction block 10 with the vertical groove formed for inserting the vertical reinforcement to the construction block 20 in such a manner that the opening 29 will be occluded by the side face wall of the construction block 10.

Figure 12:
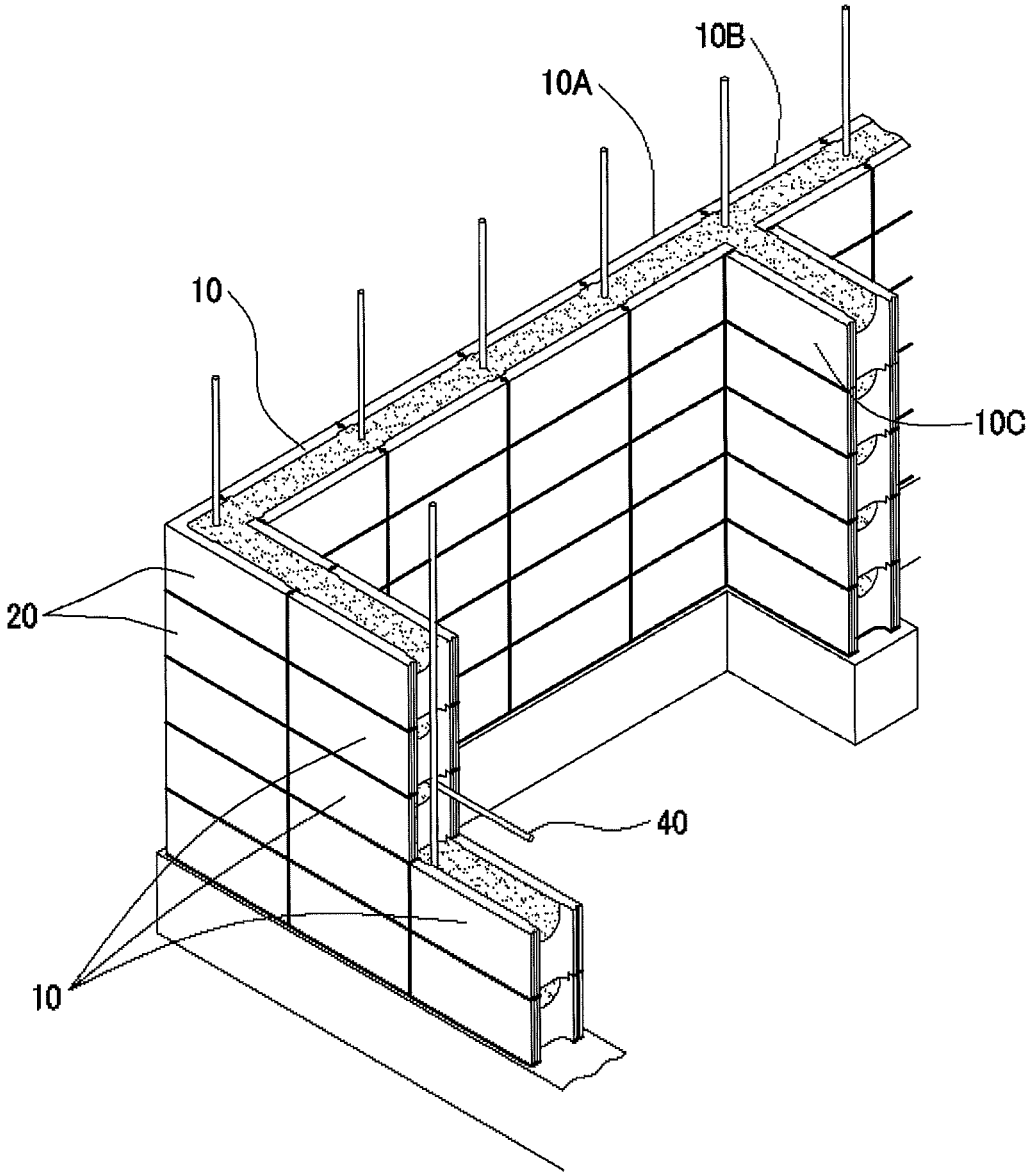
FIG. 12 is a perspective view illustrating an example of a wall face structure formed by piling the construction blocks applying the present invention.

Therefore, by using the construction blocks 10 and 20 with the structure as the above, a wall face structure 70 is constructed by bonding and fixing each construction block to each other by aligning the construction blocks 10 with the vertical grooves 14(R) and 14(L) formed for inserting the vertical reinforcement on both of the side face walls 15(R) and 15(L) in horizontal direction, and by arranging the construction blocks 20 with the vertical hole 29 formed for inserting the vertical reinforcement penetrating in vertical direction on the side face wall at ends of the horizontal direction, and by abutting outer peripheral surfaces of each construction block to each other, and by aligning the plurality of construction blocks in planer shape by engaging the plurality of protrusions of the construction blocks positioned at upper side to the horizontal grooves of the construction blocks positioned at lower side, and by filling mortar into the vertical grooves and the vertical holes inserted with the vertical reinforcements, and by filling mortar into the horizontal grooves inserted with the horizontal reinforcements, and by intervening joint mortar between abutting surfaces of the construction blocks, wherein, as illustrated in FIG. 12, the wall face structure 70 may include a wall face structure 70A formed by three construction blocks 10A, 10B and 10C abutted in T-shape, and further, the wall face structure 70 may include a wall face structure 70B formed by two construction blocks 10 and 20 abutted in L-shape.

Figure 13:
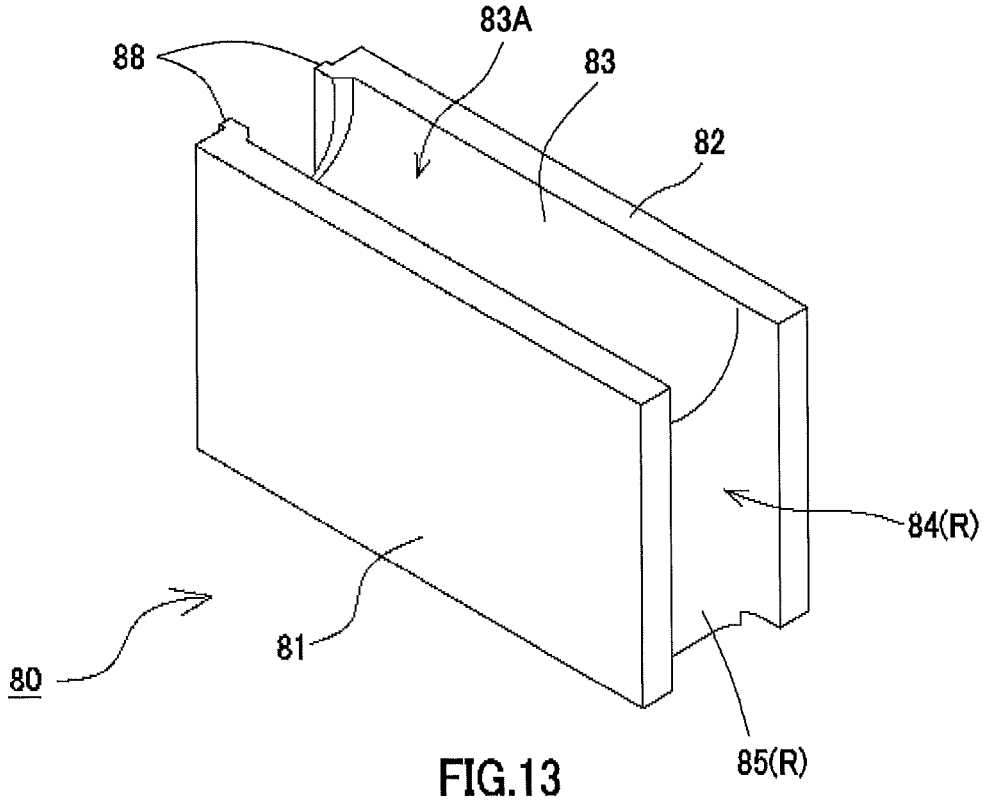
FIG. 13 is a perspective view illustrating an example of other construction blocks applying the present invention.
Figure 14:
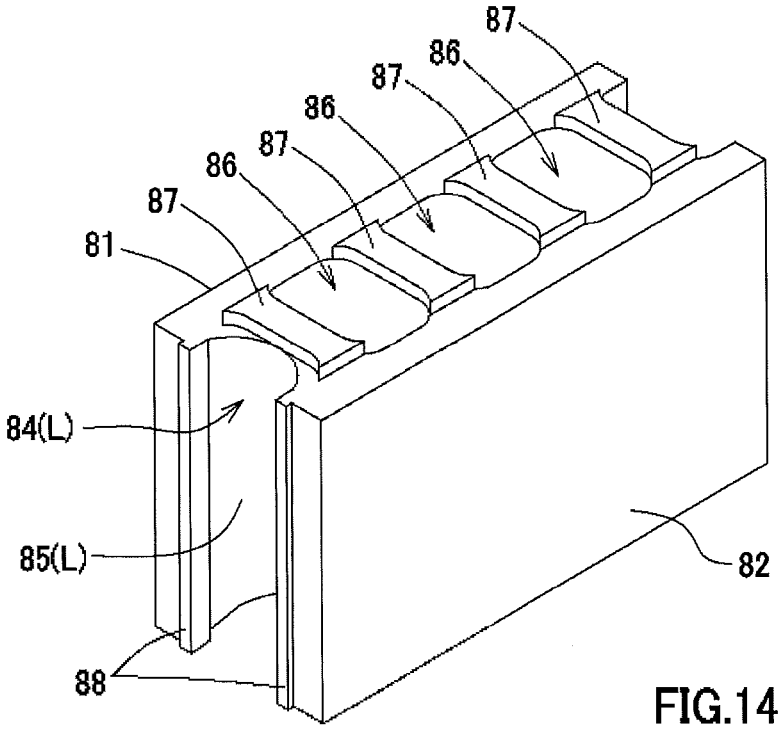
FIG. 14 is a perspective view of the construction block being upside down seen from above obliquely.

FIGS. 13 and 14 are views illustrating other embodiment of a construction block relating to the present invention, and FIG. 13 is a perspective view of a construction block 80 applying the present invention seen from above obliquely, and FIG. 14 is a perspective view of the construction block 80 being upside down seen from above obliquely.

The construction block 80 of this embodiment is for example a construction concrete block used for construction of wall or fence, comprising: a front face wall 81 and a rear face wall 82 being parallel to each other; a top face wall 83 with horizontal groove 83A formed for inserting horizontal reinforcement; side face walls 85 with vertical grooves 84 formed for inserting vertical reinforcements; at least one vertical hole 86 formed between both of the side face walls 85(R) and 85(L) and closed off by the top face wall 83 and opened at a bottom face; a plurality of protrusions 87 formed on the bottom face in a shape to engage with the horizontal groove 83A; and protruding strips 88 formed in vertical direction respectively on each side face of the front face wall 81 and the rear face wall 82.

In this construction block 80, as illustrated in FIG. 13, it comprises: a front face wall 81 and a rear face wall 82 being parallel to each other; a right side face wall 85(R) with a vertical groove 84(R) formed for inserting a vertical reinforcement; and a left side face wall 85(L) with a vertical groove 84(L) formed for inserting a vertical reinforcement.

Also, this construction block 80 comprises three vertical holes 86 formed between both of the side face walls 85(R) and 85(L), as illustrated in FIG. 14. The three vertical holes 86 are closed off by the top face wall 83 and opened at the bottom face.

Also, this construction block 80 comprises four protrusions 87 protruding from bottom face of side walls between the vertical grooves 84(R) and 84(L) and the vertical holes 86, as illustrated in FIG. 14. The four protrusions 87 are formed on the bottom face in such a manner that they respectively continue over full width of the horizontal groove 83A in width direction of the horizontal groove 83A and that they are distributed in horizontal direction of the horizontal groove 83A, and they are having a shape to engage with the horizontal groove 83A formed on the top face wall 83 in a state securing a space for inserting the horizontal reinforcement.

Further, this construction block 80 comprises a pair of protruding strips 88 formed continuously in vertical direction to protrude in horizontal direction from the side face wall 85(L) on one end face of the front face wall 81 and the rear face wall 82, as illustrated in FIGS. 13 and 14. The pair of protruding strips 88 comprises an outer wall face formed approximately in same plane with each inner wall face of the front face wall 81 and the rear face wall 82.

Figure 15:
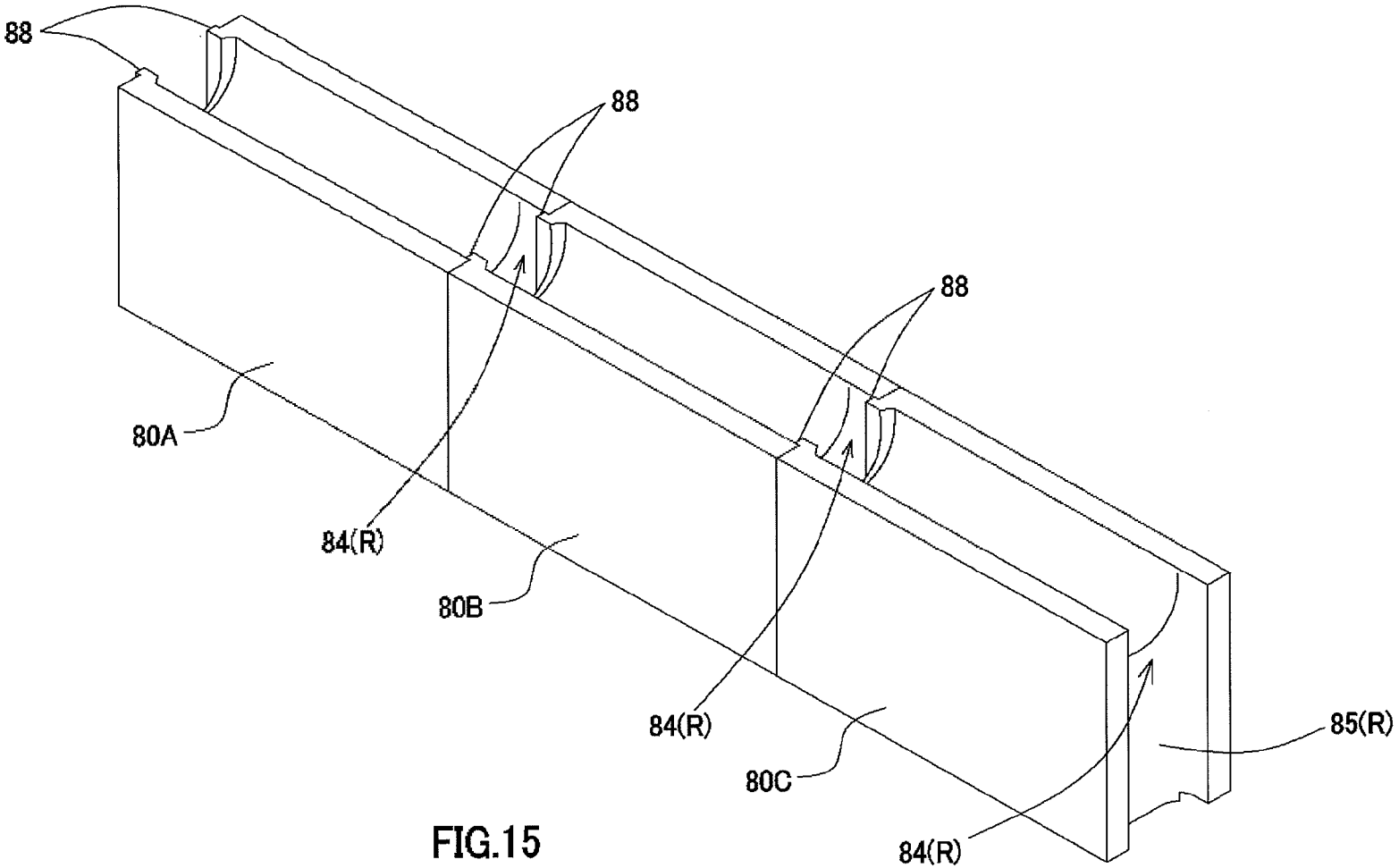
FIG. 15 is a perspective view illustrating a state that the construction blocks are aligned in horizontal direction.

In the construction block 80 with this kind of structure, for example as illustrated in FIG. 15, when aligned in horizontal direction, it is possible to increase durability of a wall face structure by engaging the pair of protruding strips 88 of a construction block 80B to the side face wall 85(R) of a construction block 80A arranged adjacently, and by engaging the pair of protruding strips 88 of a construction block 80C to the side face wall 85(R) of the construction block 80B arranged adjacently.

In other words, in this construction block 80, it is possible to increase durability of a wall face structure surely by engaging the plurality of protrusions 87 of the construction blocks position at upper side to the horizontal grooves 83A of the construction blocks position at lower side when constructing the wall face structure by aligning a plurality of the construction blocks in planar shape as well as the construction blocks 10, and also by engaging the pair of protruding strips 88 of the construction block positioned in horizontal direction to the side face wall 85(R) of the construction block positioned adjacently.

In addition, in the construction block 80, it comprises the pair of protruding strips 88 formed continuously in vertical direction to protrude in horizontal direction from the side face wall 85(L) on one end face of the front face wall 81 and the rear face wall 82, but instead of the pair of protruding strips 88, it may comprise one protruding strip continuing over full width of the vertical groove, and further, it may comprise a plurality of protrusions distributing in vertical direction, as long as it is in a shape capable of engaging with the side face wall 85(R) of the construction block positioned adjacently.

GLOSSARY OF DRAWING REFERENCES

10, 10A, 10B, 10C, 20, 80, 80A, 80B, 80C Construction block
11, 21, 81 Front face wall
12, 22, 82 Rear face wall
13A, 23A, 83A Horizontal groove
13, 23, 83 Top face wall
14(R), 14(L), 24, 84(R), 84(L) Vertical groove
15(R), 15(L), 25(R), 25(L), 85(R), 85(L) Side face wall
16, 26, 86 Vertical hole
17, 27, 87 Protrusion
18, 28 Recessed slit
29 Vertical hole
50, 60, 70, 70A, 70B Wall face structure
88 Protruding strip

The invention claimed is:

1. A construction block with a basic form of rectangular cube and capable of constructing a wall face structure by aligning a plurality of construction blocks in planar shape by abutting outer peripheral surfaces to each other, comprising:

a front face wall and a rear face wall being parallel to each other;

a top face wall with a horizontal groove formed for inserting a horizontal reinforcement;

side face walls with at least one vertical groove formed for inserting a vertical reinforcement;

at least one vertical hole formed between both of the side face walls and closed off by the top face wall and opened at a bottom face;

a plurality of protrusions formed on the bottom face in a shape to engage with the horizontal groove; and recessed slits respectively formed in vertical direction on each side face of the front face wall and the rear face wall, wherein the plurality of protrusions are formed on the bottom face to respectively continue over full width of the horizontal groove in width direction of the horizontal groove and that distributed in horizontal direction of the horizontal groove.

2. The construction block according to claim 1, wherein the vertical groove for inserting the vertical reinforcement is formed on both of the side face walls.

3. The construction block according to claim 1, wherein the vertical groove for inserting the vertical reinforcement is formed on one of the side face walls, and a vertical hole for inserting the vertical reinforcement penetrating in vertical direction is formed on another of the side face walls.

4. A construction block with a basic form of rectangular cube and capable of constructing a wall face structure by aligning a plurality of construction blocks in planar shape by abutting outer peripheral surface to each other, comprising:

a front face wall and a rear face wall being parallel to each other;

a top face wall with a horizontal groove formed for inserting a horizontal reinforcement;

side face walls with at least one vertical groove formed for inserting a vertical reinforcement;

at least one vertical hole formed between both of the side face walls and closed off by the top face wall and opened at a bottom face;

a plurality of protrusions formed on the bottom face in a shape to engage with the horizontal groove; and a pair of protruding strips formed continuously in vertical direction to protrude in horizontal direction from one of the side face walls respectively on one end face of the front face wall and the rear face wall and formed in a shape to engage with another of the side face walls, wherein the plurality of protrusions are formed on the bottom face in such a manner that respectively continue over full width of the horizontal groove in width direction of the horizontal groove and that distributed in horizontal direction of the horizontal groove.

5. The construction block according to claim 4, wherein the vertical groove for inserting the vertical reinforcement is formed on both of the side face walls.

6. The construction block according to claim 4, wherein the vertical groove for inserting the vertical reinforcement is formed on one of the side face walls, and a vertical hole for inserting the vertical reinforcement penetrating in vertical direction is formed on the other of the side face walls.

7. A wall face structure constructed by construction blocks with a basic form of rectangular cube, comprising:

a front face wall and a rear face wall being parallel to each other;

a top face wall with a horizontal groove formed for inserting a horizontal reinforcement;

side face walls with at least one vertical groove formed for inserting a vertical reinforcement;

at least one vertical hole formed between both of the side face walls and closed off by the top face wall and opened at a bottom face;

a plurality of protrusions formed on the bottom face in a shape to engage with the horizontal groove; and recessed slits respectively formed in vertical direction on each side face of the front face wall and the rear face wall, wherein the plurality of protrusions are formed on the bottom face in such a manner that respectively continue over full width of the horizontal groove in width direction of the horizontal groove and that distributed in horizontal direction of the horizontal groove, wherein the wall face structure is constructed by bonding and fixing each construction block to each other by aligning the construction blocks with vertical grooves formed for inserting vertical reinforcements on both of the side face walls in horizontal direction, and by arranging construction blocks with the vertical groove formed for inserting the vertical reinforcement on one of the side face walls and with a vertical hole formed for inserting the vertical reinforcement penetrating in vertical direction on another of the side face walls at ends of the horizontal direction, and by abutting outer peripheral surfaces of each construction block to each other, and by aligning a plurality of construction blocks in planer shape by engaging the plurality of protrusions of the construction blocks positioned at upper side to horizontal grooves of the construction blocks positioned at lower side, and by filling mortar into the vertical grooves and vertical holes inserted with the vertical reinforcements, and by filling mortar into the horizontal grooves inserted with horizontal reinforcements, and by intervening joint mortar between abutting surfaces of the construction blocks.

8. The wall face structure according to claim 7, further comprising a wall face structure formed by three construction blocks abutted in T-shape, comprising a vertically continuing opening formed by deleting an abutment of each front face wall or each rear face wall of two construction blocks arranged adjacently in horizontal direction with their side face wall opposing to each other, and constructed by abutting each side face of the front face wall or the rear face wall of other construction block to the two construction blocks so that the opening will be occluded by the side face wall of one of the two construction blocks with the vertical groove formed for inserting the vertical reinforcement.

9. The wall face structure according to claim 7, further comprising a wall face structure formed by abutting two construction blocks in L-shape, comprising a vertically continuing opening formed by deleting an abutment of the front face wall or the rear face wall of construction block positioned at end of horizontal direction, and constructed by abutting each side face of the front face wall or the rear face wall of other construction block to the construction so that the opening will be occluded by the side face wall of the other construction block with the vertical groove formed for inserting the vertical reinforcement.

10. A wall face structure constructed by construction blocks with a basic form of rectangular cube, comprising:

a front face wall and a rear face wall being parallel to each other; a top face wall with horizontal groove formed for inserting horizontal reinforcement;

side face walls with at least one vertical groove formed for inserting a vertical reinforcement;

at least one vertical hole formed between both of the side face walls and closed off by the top face wall and opened at a bottom face;

a plurality of protrusions formed on the bottom face in a shape to engage with the horizontal groove; and a pair of protruding strips formed continuously in vertical direction to protrude in horizontal direction from one of the side face walls respectively on one end face of the front face wall and rear face wall and formed in a shape to engage with another of the side face walls, wherein the plurality of protrusions are formed on the bottom face in such a manner that respectively continue over full width of the horizontal groove in width direction of the horizontal groove and that distributed in horizontal direction of the horizontal groove, wherein the wall face structure is constructed by bonding and fixing each construction block to each other by aligning the construction blocks with vertical grooves formed for inserting vertical reinforcements on both of the side face walls in horizontal direction, and by arranging construction blocks with the vertical groove formed for inserting the vertical reinforcement on one of the side face walls and with a vertical hole formed for inserting the vertical reinforcement penetrating in vertical direction on another of the side face walls at ends of the horizontal direction, and by abutting outer peripheral surfaces of each construction block to each other, and by aligning a plurality of construction blocks in planer shape by engaging the plurality of protrusions of the construction blocks positioned at upper side to horizontal grooves of the construction blocks positioned at lower side, and by filling mortar into the vertical grooves and vertical holes inserted with the vertical reinforcements, and by filling mortar into the horizontal grooves inserted with horizontal reinforcements, and by intervening joint mortar between abutting surfaces of the construction blocks.

11. The wall face structure according to claim 10, further comprising a wall face structure formed by three construction blocks abutted in T-shape, comprising a vertically continuing opening formed by deleting an abutment of each front face wall or each rear face wall of two construction blocks arranged adjacently in horizontal direction with their side face wall opposing to each other, and constructed by abutting each side face of the front face wall or the rear face wall of other construction block to the two construction blocks in such a manner that the opening will be occluded by the side face wall of the other construction block with the vertical groove formed for inserting the vertical reinforcement.

12. The wall face structure according to claim 10, further comprising a wall face structure formed by abutting two construction blocks in L-shape, comprising a vertically continuing opening formed by deleting an abutment of the front face wall or the rear face wall of construction block positioned at end of horizontal direction, and constructed by abutting each side face of the front face wall or the rear face wall of other construction block to the construction block in such a manner that the opening will be occluded by the side face wall of the other construction block with the vertical groove formed for inserting the vertical reinforcement.

* * * * *